US006005763A

United States Patent [19]

North

[11] Patent Number: 6,005,763

[45] Date of Patent: Dec. 21, 1999

[54] PULSED-ENERGY CONTROLLERS AND METHODS OF OPERATION THEREOF

[75] Inventor: Christopher North, Woodland Park, Colo.

[73] Assignee: Sturman Industries, Inc., Woodland Park, Colo.

[21] Appl. No.: 09/026,627

[22] Filed: Feb. 20, 1998

[51] Int. Cl.[6] ..... H01H 47/32

[52] U.S. Cl. ..... 361/154; 361/169.1; 361/191; 123/490

[58] Field of Search ..... 361/143–144, 361/152–156, 159, 160, 166–167, 168.1, 169.1, 189, 191, 195; 123/478, 490

[56] References Cited

U.S. PATENT DOCUMENTS

| | | | |
|---|---|---|---|
| 3,683,239 | 8/1972 | Sturman . | |
| 3,700,985 | 10/1972 | Applequist | 361/154 |
| 3,743,898 | 7/1973 | Sturman . | |
| 3,821,967 | 7/1974 | Sturman et al. . | |
| 4,065,096 | 12/1977 | Frantz et al. . | |
| 4,107,546 | 8/1978 | Sturman et al. . | |
| 4,108,419 | 8/1978 | Sturman et al. . | |
| 4,114,647 | 9/1978 | Sturman et al. . | |
| 4,355,619 | 10/1982 | Wilkinson | 123/490 |
| 4,409,368 | 10/1983 | Sturman et al. . | |
| 4,648,580 | 3/1987 | Kuwano et al. . | |
| 4,811,221 | 3/1989 | Sturman et al. . | |
| 5,108,070 | 4/1992 | Tominaga . | |
| 5,251,659 | 10/1993 | Sturman et al. . | |
| 5,293,551 | 3/1994 | Perkins et al. . | |
| 5,402,760 | 4/1995 | Takeuchi et al. | 123/300 |
| 5,460,329 | 10/1995 | Sturman . | |
| 5,598,871 | 2/1997 | Sturman et al. . | |
| 5,640,987 | 6/1997 | Sturman . | |
| 5,644,280 | 7/1997 | Wilson et al. . | |
| 5,796,223 | 8/1998 | Ohtsuka et al. | 318/126 |

FOREIGN PATENT DOCUMENTS

| | | |
|---|---|---|
| 0 184 940 | 6/1986 | European Pat. Off. . |
| 0 366 622 A2 | 5/1990 | European Pat. Off. . |
| 0 570 986 A2 | 11/1993 | European Pat. Off. . |
| 0 897 056 A1 | 2/1999 | European Pat. Off. . |
| 1 465 283 | 2/1977 | United Kingdom . |
| WO 96/17167 | 6/1996 | WIPO . |

*Primary Examiner*—Jeffrey Gaffin
*Assistant Examiner*—Kim Huynh
*Attorney, Agent, or Firm*—Blakely, Sokoloff, Taylor & Zafman LLP

[57] ABSTRACT

Pulsed-energy controllers and methods of operation thereof for driving inductive loads such as the actuator coil or coils of electromechanical actuators. The controllers utilize an inductor through which an initial current is established through a first circuit. The inductor is then switched across the actuator coil or other inductive load in a second circuit and the first circuit is opened. The back EMF of the inductor, limited by a high voltage protective device, causes a rapid rise in the current through the actuator coil, the rise being much faster than could be achieved by merely coupling the supply voltage, as used to establish the current in the inductor, directly to the actuator coil. By proper selection of the controller circuit and its parameters, the initial rapid current rise may continue to a current higher than a steady state current, after which the current will decrease to or toward the lower steady state current until the current pulse is terminated. Various embodiments are disclosed.

14 Claims, 6 Drawing Sheets

PULSED-ENERGY CONTROLLERS AND METHODS OF OPERATION THEREOF

BACKGROUND OF THE INVENTION

1. Field of the Invention

The present invention relates to the field of DC driven electromagnetic actuators and drive circuits therefor.

2. Prior Art

DC driven electromagnetic actuators of various types are well known in the prior art, both in linear and angular actuator form. In many DC powered actuators, the moving member of the actuator remains in the actuated position so long as the power to the actuator is maintained, with a return spring returning the moving member of the actuator to the unactuated position on removal of power from the actuator.

DC powered electromagnetic actuators of the latching type are also well known in the prior art. In such actuators, power is applied to electromagnetically attract the moving member of the actuator to the actuated position, after which power may be removed. The moving member remains in the actuated position by the residual magnetic field due to the retentivity of the material or materials in the actuator. In some cases, the residual magnetic field is provided by a permanent magnet somewhere in the magnetic circuit, or by the inherent retentivity of the material or materials making up the magnetic field which would not normally be considered permanent magnets per se. In the latter case, latching may be provided by low retentivity materials by having a substantially zero air gap magnetic circuit when the electromagnetic actuator is in the actuated condition.

In some applications, DC electromagnetic actuators of the latching type have operated against return springs, with the latched actuator being unlatched by a controlled pulse of limited opposite magnetization polarity from the original latching pulse to demagnetize the magnetic circuit. Such latching actuators have the advantage of latching and unlatching on appropriate current pulses and to remain in either the latched or the unlatched condition for any desired length of time without further dissipation of power. Latching actuators of this kind are described, by way of example, in U.S. Pat. No. 3,683,239, 4,107,546, 4,409,638 and 4,811,221, to name a few.

DC latching electromagnetic actuators of the foregoing kind have also been used in opposing pairs, the second latching actuator replacing the return spring so that the common moving member or moving assembly for the two actuators effectively latches in either of two positions. Though demagnetizing the magnetic circuit of one actuator while magnetizing the magnetic circuit of the other actuator could be done to effect actuation in either direction, normally the opposing actuators are each provided with sufficient pulling force to overcome the force caused by the retentivity of the magnetic circuit of the other actuator, making use of demagnetizing pulses unnecessary. Actuators of this general type are disclosed in U.S. Pat. Nos. 3,743,898, 5,460,329, 5,598,871, and 5,640,987, to name a few. The foregoing latching electromagnetic actuators have the advantage of only requiring short bursts of power when the same change state, and accordingly, as in some of the prior U.S. patents herein before referred to, are suitable for use in battery powered systems such as battery powered sprinkler systems which operate pilot-valve controlling latching actuators a few times a day or less.

Whether used in a battery operated system or not, such actuators normally require a short current pulse of substantial current for proper operation. This usually is provided by charging a capacitor of substantial size and coupling the capacitor across the actuator coil to provide the current pulse, partially or completely discharging the capacitor in the process. In battery operated systems where battery power is very limited, the current obtained in the pulse can exceed the current the battery is capable of safely providing. Even when excess power is available, capacitors are often used adjacent the actuator to avoid resistive voltage drops and noise from the switching of substantial currents through long lines. Such capacitors, however, have the disadvantage of a shorter life and lower reliability than other components of a typical system.

In some applications, speed of operation of the actuator is of prime importance. By way of example, U.S. Pat. No. 5,460,329 discloses a high speed fuel injector which uses a double solenoid spool valve to control the flow of a working fluid that is used to move an intensifier piston of an intensifier type fuel injector, typically used for diesel engine fuel injectors. As shown in that patent, an ideal diesel engine fuel injector will provide a small pre-injection (also referred to herein as a pilot injection), followed by a short delay, followed by the main injection (the graph of FIG. 3 of the foregoing patent has the abscissa inadvertently labeled in seconds instead of milliseconds). The purpose of the pilot injection is to initiate combustion, by way of a small injection, before the main injection is initiated, so that main injection combustion may start at the beginning of main injection and proceed uniformly throughout the main injection period. Without the pilot injection, there is a similar delay after the initiation of main injection before combustion begins, resulting in the characteristic diesel engine knock and energy conversion inefficiencies.

As may be seen from FIG. 3 of the foregoing patent, the ideal pilot injection lasts for a fraction of a millisecond, with a delay between the end of pilot injection and the beginning of main injection being another fraction of a millisecond in a typical diesel engine application. Also as described in the patent, ideally the full main injection flow rate is instantly established at the beginning of main injection and instantly terminated at the end of main injection. In reality, however, prior art fuel injectors have taken considerable time to reach maximum injection rate on initiation of the main injection, and similarly have been slow to terminate main injection. This varying injection rate provides further inefficiencies because much of the main injection is with non-optimum fuel droplet size, resulting in incomplete combustion and a heavy black exhaust.

Thus it may be seen that in applications such as the diesel fuel injector just described, the speed of operation of the actuator is of particular importance.

A method of rapidly energizing an electromagnetic actuator having at least one energizing coil to move a movable member, comprises establishing a current in an inductor through a first circuit; coupling the inductor in series with the coil in a second circuit; and, interrupting the first circuit and directing the current in the inductor of the first circuit to flow through the coil in the second circuit. A method of rapidly energizing a solenoid coil to move a movable member of a solenoid valve for a controlled fuel injector comprises establishing a current in an inductor through a first circuit; coupling the inductor in series with the solenoid coil in a second circuit; and, interrupting the first circuit and directing the current in the inductor of the first circuit to flow through the solenoid coil in the second circuit. A method of rapidly energizing an electromagnetic actuator having at least one energizing coil having first and second coil leads comprises providing an inductor having first and second inductor leads; coupling the first coil lead and the first inductor lead to a first power supply terminal; coupling the second inductor lead through a first diode to the first coil lead and through a first switch to a second power supply terminal; coupling the second coil lead through a second switch to the second power supply terminal; turning on the first switch to establish a current in the inductor; turning on the second switch to couple the inductor in series with the coil; and, turning off the first switch to direct the current in the inductor into the coil. A controller circuit for electromagnetic actuators having at least one energizing coil with first and second coil leads comprises first and second switches; an inductor having first and second inductor leads, the first inductor lead being coupled to a first power supply terminal, the first and second inductor leads being coupled to the first coil lead through first and second diodes, respectively; the first switch controllably coupling the second inductor lead to a second power supply terminal; the second switch controllably coupling the second coil lead to the second power supply terminal, and, a third switch and a third diode coupled in series together and in parallel with the inductor between the first and second inductor leads.

BRIEF SUMMARY OF THE INVENTION

The controller circuits and methods of actuating an electromagnetic actuator are provided for driving inductive loads such as an actuator coil or coils of electromechanical actuators. The controllers utilize an inductor through which an initial current is established through a first circuit. The inductor is then switched across the actuator coil or other inductive load in a second circuit and the first circuit is opened. The back EMF of the inductor, limited by a high voltage protective device, causes a rapid rise in the current through the actuator coil, the rise being much faster than could be achieved by merely coupling the supply voltage, as used to establish the current in the inductor, directly to the actuator coil. By proper selection of the controller circuit and its parameters, the initial rapid current rise may continue to a current higher than a steady state current, after which the current will decrease to or toward the lower steady state current until the current pulse is terminated.

The present invention has two characteristics which give it various advantages over the prior art, depending upon what prior art it is compared to. These characteristics are the ability to provide a very short rise time for the drive current to an actuator coil, and the ability to provide that short rise time to a current level exceeding the steady state current through the actuator coil. Thus, in comparison to simply applying a drive voltage to an actuator coil wherein the current rise will be limited to the time constant, the present invention will grossly reduce the rise time required. One approach to reducing the actuation time of a two solenoid actuator is to power both solenoid coils, and then terminate the current to one of the solenoids so that the other solenoid may cause the moving member to move to the solenoid still being driven. While this increases the speed of operation of the valve, it should be noted that the solenoid actually doing the actuation is initially at its largest air gap. Accordingly, an initial drive current above what would be the steady state current normally can be advantageously used to increase the magnetic field strength actuating the solenoid, as can be done in the present invention. Further, the present invention could be used in conjunction with such a mode of operation also, though that is not preferred. Also, the motion of the moving member during the excitation of one of the actuator coils may be monitored by analyzing the back EMF of the second actuator coil, the back EMF having a predetermined characteristic when the motion of the moving member is completed. This, of course, is advantageous, as it allows termination of the current pulse shortly after the moving member has arrived at its commanded destination, minimizing the duty cycle experienced by the actuator coil so as to allow a powerful drive with a relatively small coil without substantial heating thereof because of the low duty cycle. Being able to determine the arrival time of the moving member at its commanded destination also allows the monitoring of performance so as to be able to sense any failure or mere deterioration in performance of the actuators. This capability, of course, may similarly be used with the present invention, as the actuator drive provided by the present invention has no meaningful effect on the back EMF characteristic of the undriven actuator coil.

DETAILED DESCRIPTION OF THE INVENTION

The present invention, as shall subsequently be described in greater detail, may be used with DC actuators of the latching or of the non-latching type, and with DC actuators using a spring or other return mechanism or multiple actuators, typically two actuators operating on a common moving member or moving assembly. However, since the preferred embodiment of the present invention is intended to be used with double solenoid spool valves of the general type shown in U.S. Pat. No. 5,460,329, the preferred embodiment of the invention will be described with respect to such valves.

Figure 1:
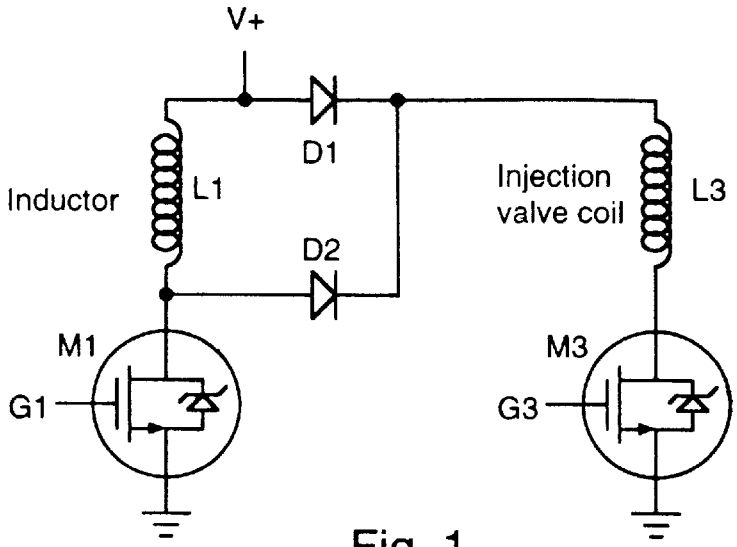
FIG. 1 is a circuit diagram illustrating one of the main aspects of the present invention.
Figure 2:
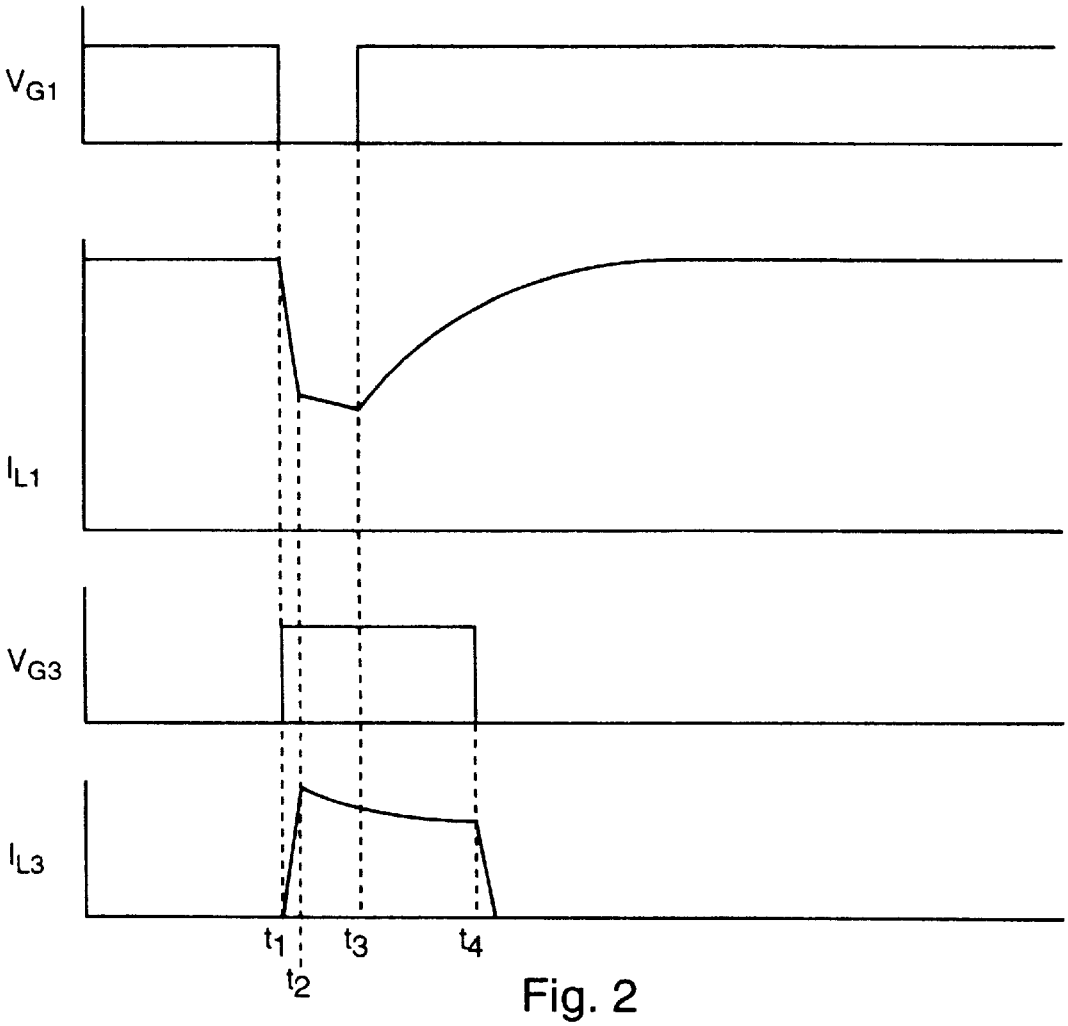
FIG. 2 illustrates exemplary current and voltage waveforms for the circuit of FIG. 1.

One of the main aspects of the present invention may be described with respect to the circuit of FIG. 1 and the current and voltage waveforms for that circuit as shown in FIG. 2. Thus, as shown in FIG. 1, two n-channel power MOS transistors M1 and M3 are shown, each with an internal zener diode to limit the back EMF of an inductive load connected thereto to a voltage below the voltage capability of the MOS transistor. In the specific devices used, the n-channel power transistors are readily commercially available devices, each packaged together with an approximately 200 volt zener as shown. Also shown in FIG. 1 is an inductance L1 and an injection valve coil of a solenoid valve controlling a fuel injector forming an inductance L3. Diode D1 allows current flow from the positive power supply V+ to inductance L3, preventing reverse current flow from the inductance back to the positive power supply. Diode D2 similarly allows current flow from the junction between inductance L1 and the drain of MOS transistor M1 to inductance L3 and prevents current flow in the reverse direction.

The operation of the circuit of FIG. 1 may be best illustrated with respect to FIG. 2. As shown in that Figure, assume that the voltage $V_{G1}$ on the gate G1 of transistor M1 is high, holding transistor M1 on to provide a current flow $I_{L1}$ through inductance L1. It is assumed in FIG. 2 that the current flow in inductance L1 is limited at some steady state value, perhaps caused by the resistance of inductance L1, and perhaps further limited by a separate resistance added to the circuit for that purpose (not shown), preferably in the drain circuit of transistor M1. At this time, the voltage $V_{G3}$ on the gate G3 of transistor M3 is held low, holding that transistor off so that the current $I_{L3}$ in inductance L3 is zero.

At time $t_1$, the voltage $V_{G3}$ on the gate G3 of transistor M3 is driven high to turn transistor M3 on, and then as soon thereafter as reasonably possible, the voltage $V_{G1}$ of gate G1 of transistor M1 is driven low to turn off transistor M1. Now inductance L1, which has a current therethrough, is connect ed to inductance L3, which has no current therethrough, through diode D2. in theory, if one simply connects and ideal inductance L1 having a current $I_{L1}$ therethrough to a second ideal inductance L3 having no current therethrough, an infinite voltage spike between the two inductances would result, after which the current $I_A$ through the two inductances would be equal, and that current ($I_A$) times the total inductance (L1+L3) after the connection would equal the sum of the initial currents times the respective inductances through which those currents initially flowed ($I_{L1}$*L1)+(0* L3). Thus, in an ideal system, immediately after turning on transistor M3 and turning off transistor M1, the current $I_A$ through inductance L1, diode D2 and inductance L3 would be given by the following equation:

$$I_A = I_{L1}\left(\frac{L1}{L1 + L3}\right) \quad \text{(Eq. 1)}$$

If transistor M3 is left on for a prolonged period, the current flow in inductance L1 will have stopped and the steady state current flow $I_{L3}$ through inductance L3 will be given by the following equation:

$$I_{L3} = \frac{((V+) - V_{D1})}{R_{L3}} \quad \text{(Eq. 2)}$$

where:

$V_{D1}$=the forward conduction voltage drop across diode D1, and $R_{L3}$=the resistance associated with inductance L3

A comparison of Equations 1 and 2 shows that the steady state current through inductance L3 is limited by the supply voltage V+ and the resistance $R_{L3}$ associated with inductance L3. However, the current immediately after connecting the inductance L1 with inductance L3 by turning on transistor M3 and then immediately turning off transistor M1 is not so limited. In particular, the initial current $I_{L1}$ through inductance L1 may be relatively high, and inductance L1 itself may be of a relatively high value in comparison to the inductance L3 of the actuator coil, so that the current $I_A$ through inductances L1 and L3 immediately after connecting the inductances together may be substantially higher than the steady state current through inductance L3 by merely turning on transistor M3.

In a real system, the height of the momentary voltage spike (the back EMF of inductance $L_1$) decreasing the current through inductance L1 and increasing the current through inductance L3 is limited by the zener breakdown voltage of the zener associated with transistor M1, which in the preferred embodiment is approximately 200 volts. Consequently, the voltage spike across inductance L3 forcing current therethrough will be limited to the zener voltage. However, for a 12 volt, 24 volt or even a 48 volt system, the rate of rise of the current through inductance L3 is many times faster than would be achieved by merely connecting the power supply voltage V+ across the inductance. Other real world effects may also have an effect on the rate of rise of the current $I_{L3}$ when transistor M3 is turned on and transistor M1 is turned off, such as the distributed capacitance in the inductances, the limited time rate of penetration of the magnetic field into the actuator magnetic circuit under a rapidly changing current through inductance L3 (such actuators may have solid stationary and moving members within which eddy currents will slow the penetration of magnetic fields), and motion of the moving member of the actuator in response to the magnetic fields generated by the current through inductance L3.

In any event, referring again to FIG. 2, once transistor M3 is turned on and transistor M1 is turned off at time $t_1$, the current $I_{L1}$, shown as initially being relatively high, will rapidly drop, while the current $I_{L3}$ will rapidly rise, until at time $t_2$, after the initial transient, the currents $I_{L1}$ and $I_{L3}$ will be equal. If this current is actually higher than the steady state current through inductance L3, the voltage across inductance L3 will be higher than V+ minus the voltage drop across diode D1, so that diode D1 will temporarily remain back biased with the currents in both inductances L1 and L3 remaining equal but decaying.

At time $t_3$, transistor M1 is turned on again by driving the voltage $V_{G1}$ on the gate G1 of transistor M1 high. Now the current through inductance L1 will rise again to its original steady state value, being decoupled from inductance L3 by the back biased diode D2. Current through inductance L3 will be maintained through the positive power supply voltage V+ and diode D1, the current value, however, decaying toward the steady state value as limited by the resistance of inductance L3. Finally, at time $t_4$, the voltage $V_{G3}$ on the gate G3 of transistor M3 is driven low, turning off that transistor. Now the resulting voltage spike from the back EMF of inductance L3 causes the zener associated with transistor M3 to conduct, forcing the rapid decay of the current in inductance L3 to zero.

As will be subsequently seen from actual test data, the rate of rise of current $I_{L3}$ between times t1 and t2 and the rate of decay of the current after time $t_4$ is approximately linear, suggesting that it is the zener voltage limit that is limiting the rate of both the current rise and the current fall. Thus, particularly the current rise is much faster than achievable in the prior art. Further, the extent of the current rise will depend upon the parameters chosen, and a rapid current rise to a current substantially higher than the steady state current in the actuator inductance L3 may readily be achieved.

Figure 3:
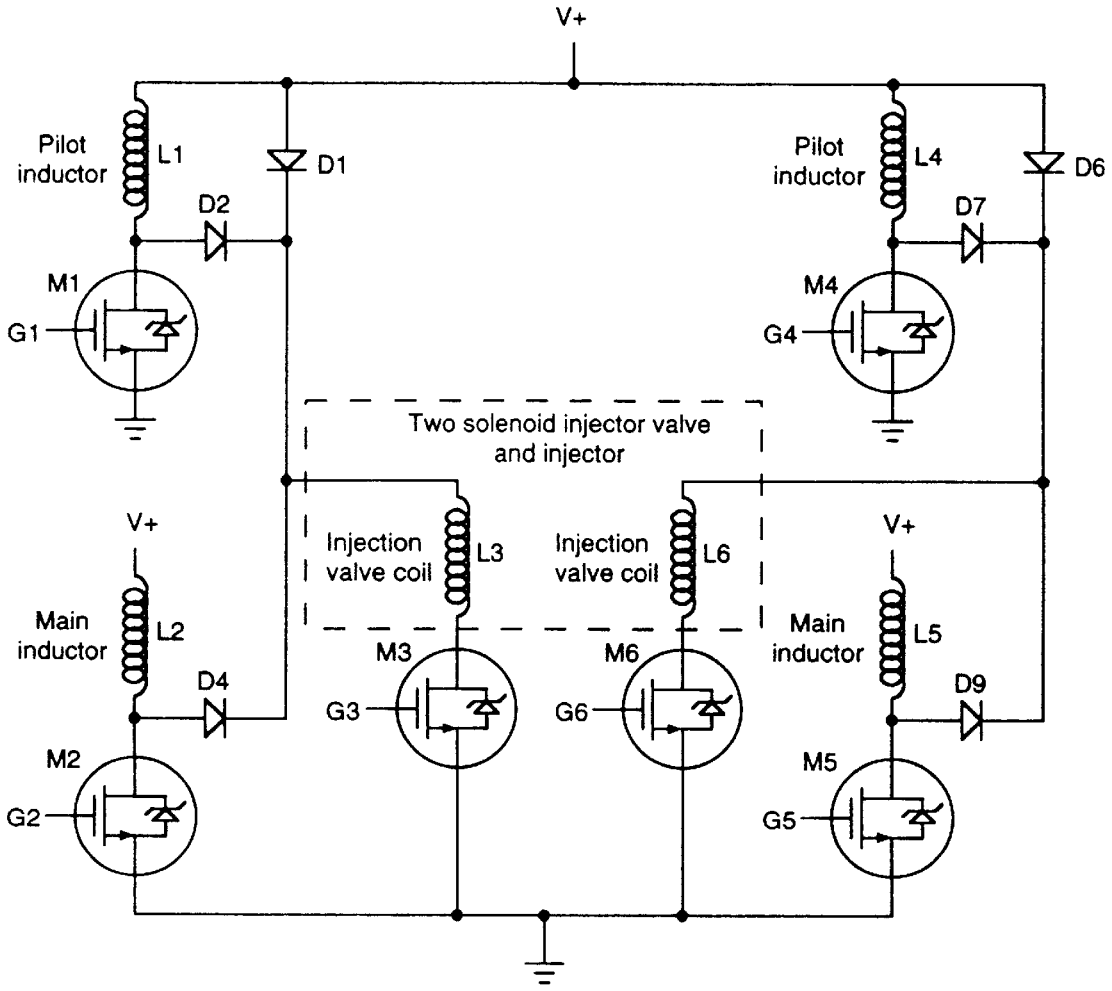
FIG. 3 is an exemplary circuit diagram applying the circuit of FIG. 1 to a two solenoid injector valve and injector of the type disclosed in U.S. Pat. No. 5,460,329, together with a pilot injection capability.

Now referring to FIG. 3, an exemplary circuit diagram applying the circuit of FIG. 1 to a two solenoid injector valve and injector of the type disclosed in U.S. Pat. No. 5,460,329, together with a pilot injection capability, may be seen. In this circuit, the inductances L3 and L6 represent the inductances of the coils of the actuators in the two solenoid spool valve controlling the injector. The combination of inductances L1 and L3, transistors M1 and M3 and diodes D1 and D2 function substantially the same as the corresponding elements described in FIG. 1. Similarly, the combination of inductances L4 and L6, transistors M4 and M6 and diodes D6 and D7 also perform substantially the same as the foregoing identified elements, controlling the current in inductance L6 of the second coil in the two solenoid spool valve. Thus, one solenoid coil may be energized and shut off to initiate pilot injection, with the opposite solenoid coil being momentarily energized shortly thereafter to return the spool of the spool valve to its original position and latch the same at that position to terminate pilot injection. Unless inductances L1 and L4 can very quickly recover the value of the initial current therethrough, these inductances will not provide the same rate of current rise for turn on and turn off of main injection. Accordingly, in the embodiment illustrated in FIG. 3, inductors L1 and L4, each labeled pilot inductor, together with transistors M1 and M4 and diodes D2 and D7, are used only for the pilot injection, with inductances L2 and L5, together with transistors M2 and M5 and diodes D4 and D9, having the same function for main injection.

Figure 4:
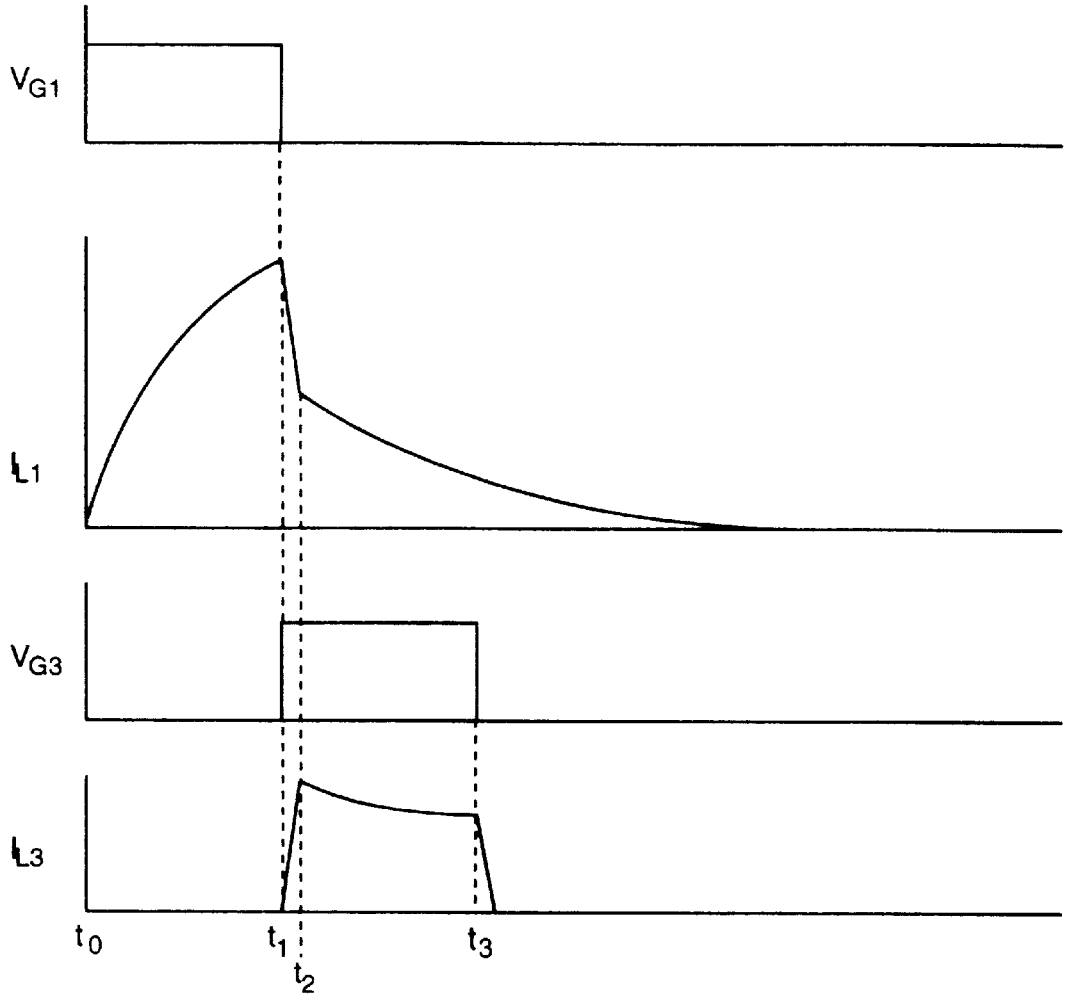
FIG. 4 illustrates a method of operating the circuit of FIG. 3 which is an alternate to the general method illustrated in FIG. 2.

Also, while different parts of the circuit of FIG. 3 could operate in the same manner as described with respect to the basic circuit of FIG. 1, FIG. 4 illustrates an alternate method of operation of the circuit. In particular, inductors L1 and L2 are intentionally made not only with the desired inductance, but with a relatively short time constant. Thus, at time $t_0$, before pilot injection is commenced, the voltage $V_{G1}$ on gate G1 of transistor M1 is driven high, turning on the transistor. As shown in FIG. 4, the current $I_{L1}$ in inductance L1 rises reasonably quickly because of the short time constant of the inductor. However, before the current in inductance L1 stabilizes, the voltage $V_{G3}$ on the gate G3 of transistor MB is driven high to turn the transistor on, and the voltage $V_{G1}$ on the gate G1 of transistor M1 is driven low immediately thereafter to turn off transistor M1. As before, this last sequence causes a very rapid drop in the current $I_{L1}$ in inductance L1 and a rapid rise in the current $I_{L3}$ in the actuator inductance L3 until the two currents are equal. Unlike FIG. 2, the voltage $V_{G1}$ on the gate G1 of transistor M1 is left low until just before the beginning of the next injection cycle. Because main injection commences so shortly after the initiation of pilot injection, a separate inductance L2 together with diode D4 and controlling transistor M2 are provided. Further, of course, termination of pilot injection and termination of main injection when using a two solenoid injector valve such as the two solenoid latching spool valve used in the preferred embodiment, is simply a matter of similarly driving the second solenoid coil using the same basic circuits as were used to initiate pilot and main injection respectively. Thus, the circuit comprised of inductance L1, diodes D1, D2, D3 and transistor M1 is replicated for termination of pilot injection by inductance L4, diodes D6, D7 and D8 and transistor M4. Similarly, the circuit used to initiate main injection comprising inductance L2, diodes D4 and D5 and transistor M2 is replicated for the termination of main injection as inductance L5, diodes D9 and D10 and transistor M5. Obviously in spool or other types of valves utilizing a spring return, replication of the circuit would not be necessary, though of course a spring return would not have the full speed advantages of the present invention.

Figure 5:
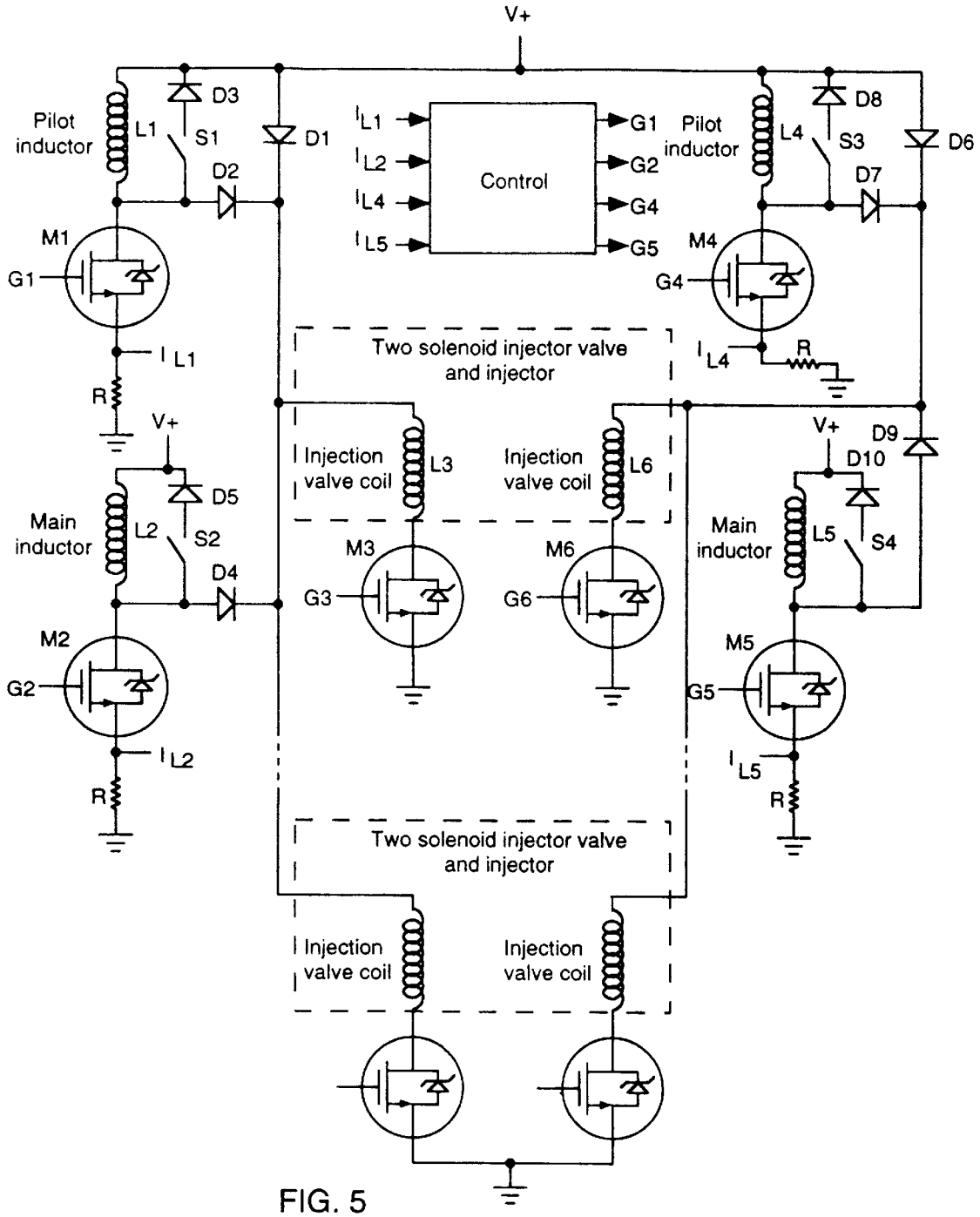
FIG. 5 is a circuit diagram similar to FIG. 3, but further incorporating circuitry for switching regulation of the current in certain inductances and illustrating the operation of numerous injectors from a single drive circuit.

The operating cycle described with respect to FIG. 4 would be suitable for applications wherein the time between injection cycles would be substantial in comparison to the injection cycles themselves, such as in a single cylinder engine, or perhaps a two cylinder four cycle engine. Alternatively, a circuit like the circuit of FIG. 3 and an operating sequence like that of FIG. 4 could be used on each cylinder, or perhaps each pair of cylinders, of a larger engine. However, the required duplication of circuits to achieve this may be avoided by using a circuit and operating sequence as illustrated with respect to FIGS. 5 and 6. FIG. 5 is similar to FIG. 3, though diodes D3, D5, D8 and D10 have been added, as have switches S1, S2, S3 and S4. Also, a low value resistor R has been added to the source circuit of transistors M1, M2, M3 and M4 to provide a voltage proportional to the current through the respective inductances when the respective transistors are on. These voltages proportional to inductor currents are applied to a control circuit, which in turn controls the gates G1, G2, G4 and G5 of the respective transistors M1, M2, M4 and M5. Finally, the same drive circuit for initiation and termination of pilot injection and main injection is used to sequentially drive a plurality of two solenoid injector valves and injectors as in a multi-cylinder engine.

The operation of the subcircuit terminating pilot injection, the subcircuit initiating main injection and the subcircuit terminating main injection is the same as the operation of the circuit initiating pilot injection, namely inductance L1, diodes D1, D2, D3, switch S1, transistor M1 and the associated source circuit resistor R. Accordingly, only the subcircuit initiating pilot injection will be described in detail.

Figure 6:
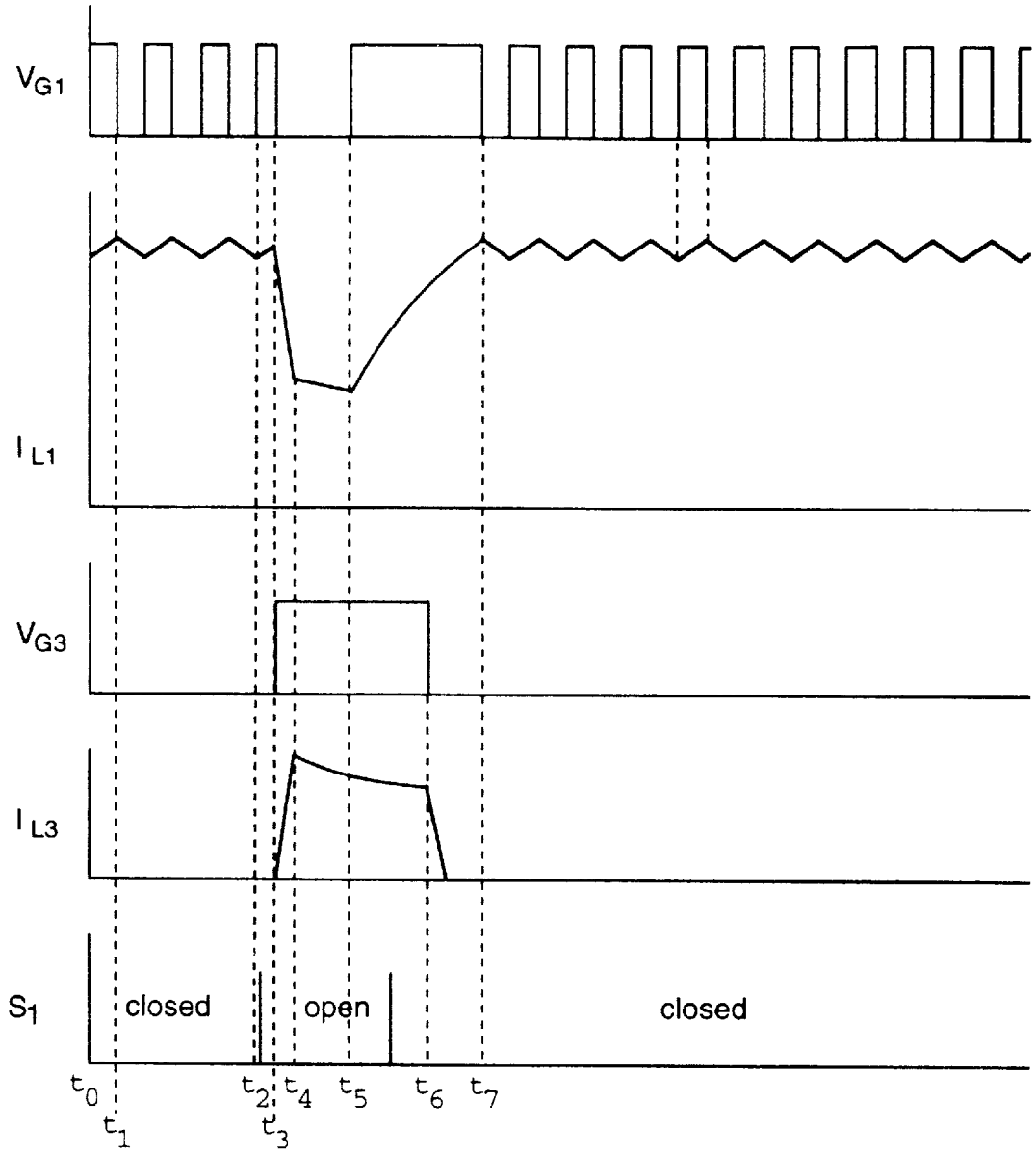
FIG. 6 illustrates exemplary current and voltage waveforms for the circuit of FIG. 5.

In FIG. 6, it is assumed that the circuit has been operating so as to have reached a stable operating condition. When not driving an actuator inductance, switch S1 will normally be closed. At time $t_0$, it is assumed that the current $I_{L1}$ in inductance L1 is at a lower control value, as measured by the voltage across resistor R. Accordingly, the control (see FIG. 5) drives the voltage $V_{G1}$ of gate G1 of transistor M1 high (see FIG. 6) to turn on the transistor. Thus, between time $t_0$ and $t_1$, the current through inductance L1 increases, reaching a higher control point limit at time $t_1$. Now the control drives the voltage $V_{G1}$ of gate G1 low, turning off transistor M1. The back EMF in inductance L1 provides current through closed switch S1 and diode D3, so that the current in inductance L1 will begin to decay until the same reaches the lower control limit again, whereupon transistor M1 is again turned on. Thus, in this mode, the circuit operates much like a switching voltage regulator, but in this case regulating the current through inductance L1 as opposed to an output voltage. In that regard, the control circuit, as in switching voltage regulators, may seek its own operating frequency as just described, or alternatively may operate at a fixed frequency but vary the duty cycle of the on time of transistor M1 to servo the current in the inductance to the desired nominal value. In FIG. 6, the ripple in the current $I_{L1}$ during this mode is exaggerated for illustration purposes, as the regulation may occur at a rate of hundreds of KHz or higher, reducing the ripple to a negligible level in terms of performance of the overall injection system.

In either event, at time $t_2$, just before pilot injection is to be initiated, the voltage $V_{G1}$ of the gate G1 of transistor M1 is driven high to turn the transistor on, if the same is not already on, and switch S1 will then be opened. This will be followed very shortly at time $t_3$ by driving the voltage $V_{G3}$ of the gate G3 of transistor M high to turn on transistor M3, and substantially immediately thereafter the voltage $V_{G1}$ on the gate G1 of transistor M1 is driven low to turn off transistor M1. As before, this connects inductance L1 having a current flowing therethrough to inductance L3 having no current flowing therethrough, through diode D2. Consequently, the current $I_{L1}$ in inductance L1 rapidly drops and the current in inductance L3 of the solenoid coil initiating pilot injection rapidly rises until at time $t_4$ the two currents are equal. The two currents then begin to decay until at time $t_5$, transistor M1 is turned on again by driving the voltage $V_{G1}$ of its gate G1 high. This may occur as soon after time $t_4$ as is reasonably convenient. Now the current $I_{L1}$ in inductance L1 begins to rise, but before the upper control limit on the current $I_{L1}$ in inductance L1 is reached, switch S1 is again closed (time $t_6$ in FIG. 6). Now when the upper control limit for the current $I_{L1}$ in inductance L1 is reached at time $t_7$, the circuit is ready to resume switching regulator operation and is in readiness for pilot injection initiation for the next cylinder to fire. As before, because main injection initiation occurs so soon after pilot injection initiation, it is preferable to use separate circuits for this purpose, as well as separate circuits for termination of pilot injection and termination of main injection. The same circuit, however, may be used for all injectors of a multi-cylinder engine by appropriate selection of parameters, the time between actuations of the double solenoid valves being long in comparison to the actual time for solenoid actuation in any engine having a practical number of cylinders.

In the foregoing description, it was stated that "at time $t_2$, just before pilot injection is to be initiated, the voltage $V_{G1}$ of the gate G1 of transistor M1 is driven high to turn the transistor on, if the same is not already on, and switch S1 will then be opened. This will be followed very shortly at time $t_3$ by driving the voltage $V_{G3}$ of the gate G3 of transistor MB high to turn on transistor M3, and substantially immediately thereafter the voltage $V_{G1}$ on the gate G1 of transistor M1 is driven low to turn off transistor M1. As before, this connects inductance L1 having a current flowing therethrough to inductance L3 having no current flowing therethrough, through diode D2." It should be noted however, alternate operating sequences may be used if desired. By way of example, at time $t_2$, just before pilot injection is to be initiated, the voltage $V_{G1}$ of the gate G1 of transistor M1 could be driven low to turn the transistor off, if the same is not already off. This would be followed very shortly at time $t_3$ by driving the voltage $V_{G3}$ of the gate G3 of transistor M3 high to turn on transistor M3, and substantially immediately thereafter switch S1 would be opened. As before, this connects inductance L1 having a current flowing therethrough to inductance L3 having no current flowing therethrough, through diode D2. In either sequence, switch S1 must also have a high forward bias breakdown voltage or it will be the limiting factor on the back EMF of inductance L1 applied to inductance L3. For that reason, switch S1, as well as switches S2, S3 and S4, may also be MOS switches with high voltage zener protection. Obviously P-channel switching devices may be used for some or all the transistors, or other switching devices could be used, as desired.

Figure 7:
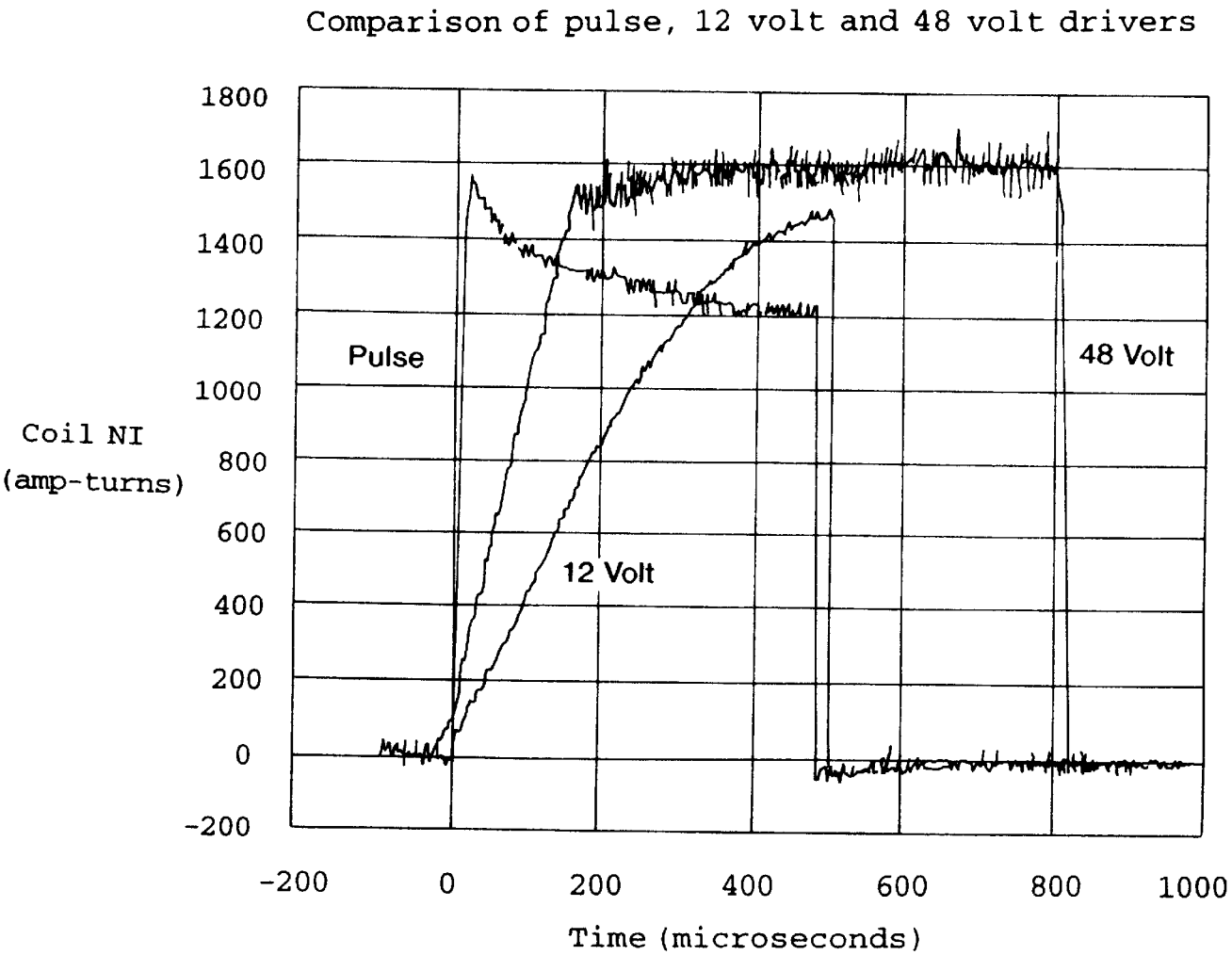
FIG. 7 is a copy of actual magnetizing force (NI) traces illustrating the operation of the present invention in comparison to the prior art.

Now referring to FIG. 7, the actual waveforms of current pulses for three different types of actuator pulse control systems may be seen. The curves shown therein represent the magnetizing force in ampere-turns versus time in microseconds. The first curve shown therein is for a conventional on-off system operating on a 12 volt supply, providing a pulse starting substantially at zero time and terminating approximately 500 microseconds later. It may be seen that the trailing edge of the pulse is very sharp, the current pulse rapidly falling from a maximum to substantially zero. This rapid termination of the current pulse is the result of merely opening the switching device coupling the actuator coil in circuit, with the high back EMF of the actuator coil being limited to a high but safe voltage through a high voltage zener diode or other protective device. The rise time for this waveform, however, is relatively slow, being limited by the R/L time constant of the actuator coil, where R is the resistance to the coil and supply lines, and L is the inductance of the coil. For the particular curve shown, it will be noted that the current pulse is still rising at a significant rate at the end of the 450 microseconds, at which time the current pulse was terminated.

By changing the actuator coil parameters or the operating voltage, or both, a faster rise in the operating current pulse in a conventional driver may be achieved. By way of example, the current pulse in an actuator coil operating from a 48 volt supply may also be seen in FIG. 7. Here, the rise time is substantially faster than the coil operating on 12 volts, the current of the current pulse being regulated by a switching regulator when a magnetizing force of approximately 1600 ampere turns has been reached. As with the 12 volt operation, the termination of the current pulse on the 48 volt curve is also very rapid, for the same reasons as hereinbefore stated with respect to the 12 volt system curve. The specific pulse shown for the 48 volt curve is approximately 800 microseconds long, though obviously this was merely a choice of how long to let the pulse run before terminating the same.

Also shown in FIG. 7 is a third curve labeled "pulse" which shows the actual current pulse for an actuator drive circuit in accordance with the present invention. This curve clearly illustrates two aspects of the invention, namely that the pulse rise rate is very rapid, comparable to the current pulse termination rate associated with the 12 volt and 48 volt systems, and that the initial current can be made to rapidly rise to a current level higher than the steady state current level for the same DC drive voltage, after which the drive current will decay with an R/L time constant to the steady state current. Of course, as with the conventional drive systems, the termination of the current pulse for the pulse curve is also very rapid.

Again, as illustrated in the foregoing curves, the present invention has two characteristics which give it various advantages over the prior art, depending upon what prior art it is compared to. These characteristics are the ability to provide a very short rise time for the drive current to an actuator coil, and the ability to provide that short rise time to a current level exceeding the steady state current through the actuator coil. Thus, in comparison to simply applying a drive voltage to an actuator coil wherein the current rise will be limited to the time constant, the present invention will grossly reduce the rise time required.

One approach to reducing the actuation time of a two solenoid actuator is to power both solenoid coils, and then terminate the current to one of the solenoids so that the other solenoid may cause the moving member to move to the solenoid still being driven. While this increases the speed of operation of the valve, it should be noted that the solenoid actually doing the actuation is initially at its largest air gap. Accordingly, an initial drive current above what would be the steady state current normally can be advantageously used to increase the magnetic field strength actuating the solenoid, as can be done in the present invention. Further, the present invention could be used in conjunction with such a mode of operation also, though that is not preferred.

Also, as disclosed in co-pending applications, in the case of dual solenoid actuator devices such as spool valves and the like, the motion of the moving member during the excitation of one of the actuator coils may be monitored by analyzing the back EMF of the second actuator coil, the back EMF having a predetermined characteristic when the motion of the moving member is completed. This, of course, is advantageous, as it allows termination of the current pulse shortly after the moving member has arrived at its commanded destination, minimizing the duty cycle experienced by the actuator coil so as to allow a powerful drive with a relatively small coil without substantial heating thereof because of the low duty cycle. Being able to determine the arrival time of the moving member at its commanded destination also allows the monitoring of performance so as to be able to sense any failure or mere deterioration in performance of the actuators. This capability, of course, may similarly be used with the present invention, as the actuator drive provided by the present invention has no meaningful effect on the back EMF characteristic of the undriven actuator coil.

While the present invention has been disclosed and described with respect to the driving of actuator coils such as used in electrical mechanical actuators, and is particularly advantageous in providing the drive for electrical mechanical actuators having a need for rapid actuation, it should be noted that the invention may also be used in driving any inductive loads wherein very short current rise times are desired and/or where an initial high current pulse, decreasing to a lower sustaining current level, is desired. Thus, while the present invention has been disclosed and described with respect to certain preferred embodiments thereof, it will be understood by those skilled in the art that various changes in form and detail may be made therein without departing from the spirit and scope of the invention.

What is claimed is:

1. A method of rapidly energizing an electromagnetic actuator having at least one energizing coil having first and second coil leads comprising:

providing an inductor having first and second inductor leads;

coupling the first coil lead and the first inductor lead to a first power supply terminal;

coupling the second inductor lead through a first diode to the first coil lead and through a first switch to a second power supply terminal;

coupling the second coil lead through a second switch to the second power supply terminal;

coupling a third switch and a third diode in series across the first and second inductor leads; and, turning on the first and third switches to establish a predetermined current in the inductor, followed by alternately turning off and turning on of the first switch to maintain the predetermined current in the inductor, and setting the first switch to being on and the third switch to being off; and, turning on the second switch and turning off the first switch to couple the inductor in series with the coil.

2. A controller circuit for electromagnetic actuators having at least one energizing coil with first and second coil leads comprising:

first and second switches;

an inductor having first and second inductor leads, the first inductor lead being coupled to a first power supply terminal, the first and second inductor leads being coupled to the first coil lead through first and second diodes, respectively;

the first switch controllably coupling the second inductor lead to a second power supply terminal;

the second switch controllably coupling the second coil lead to the second power supply terminal, and, a third switch and a third diode coupled in series together and in parallel with the inductor between the first and second inductor leads.

3. The controller circuit of claim 2 further comprised of a switch controller controlling the first switch.

4. A controller circuit for electromagnetic actuators having at least one energizing coil with first and second coil leads, the controller circuit comprising:

a first switch having a first switch terminal, a second switch terminal, and a first switch control terminal;

a second switch having a third switch terminal, a fourth switch terminal, and a second switch control terminal;

a third switch having a fifth switch terminal, a sixth switch terminal, and a third switch control terminal, the fifth switch terminal coupled to the second coil lead;

a first inductor having a first inductor lead and a second inductor lead, the first inductor lead coupled to a positive voltage supply and the second inductor lead coupled to the first switch terminal of the first switch;

a second inductor having a third inductor lead and a fourth inductor lead, the third inductor lead coupled to the positive voltage supply and the fourth inductor lead coupled to the third switch terminal of the second switch;

a first diode having a first anode and a first cathode, the first anode coupled to the positive voltage supply and the first cathode coupled to the first coil lead;

a second diode having a second anode and a second cathode, the second anode coupled to the second inductor lead and the first terminal of the first switch, the second cathode coupled to the first cathode and the first coil lead;

a third diode having a third anode and a third cathode, the third anode coupled to the fourth inductor lead of the second inductor and the third switch terminal of the second switch, the third cathode coupled to the first coil lead and the first cathode and second cathode of the first and second diodes respectively and the first coil lead;

the first switch controllably coupling the second inductor lead of the first inductor to a low level voltage supply responsive to the first switch control terminal;

the second switch controllably coupling the fourth inductor lead to the low level voltage supply responsive to the second switch control terminal, and, the third switch controllably coupling the second coil lead to the low level voltage supply responsive to the third switch control terminal.

5. The controller circuit of claim 4 for electromagnetic actuators further comprising:

a fourth switch having a seventh switch terminal, an eighth switch terminal, and a fourth switch control terminal, the eighth switch terminal coupled to the second anode of the second diode, the second inductor lead of the first inductor, and the first terminal of the first switch; and, a fourth diode having a fourth anode and a fourth cathode, the fourth anode coupled to the seventh switch terminal of the fourth switch to couple the fourth switch in series with the fourth diode, the fourth cathode coupled to the positive voltage supply such that the fourth switch coupled in series with the fourth diode are together coupled in parallel with the first inductor between the first inductor lead and the second inductor lead.

6. The controller circuit of claim 4 for electromagnetic actuators further comprising:

a fifth switch having a ninth switch terminal, a tenth switch terminal, and a fifth switch control terminal, the tenth switch terminal coupled to the third anode of the third diode, the fourth inductor lead of the second inductor, and the third switch terminal of the second switch; and, a fifth diode having a fifth anode and a fifth cathode, the fifth anode coupled to the ninth switch terminal of the fifth switch to couple the fifth switch in series with the fifth diode, the fifth cathode coupled to the positive power voltage such that the fifth switch coupled in series with the fifth diode are together coupled in parallel with the second inductor between the third inductor lead and the fourth inductor lead.

7. The controller circuit of claim 4 for electromagnetic actuators further comprising:

a first resistor having a first resistor terminal and a second resistor terminal, the first resistor terminal coupled to the second switch terminal and the second resistor terminal coupled to a low level voltage supply terminal of the low level voltage supply such that the first resistor couples between the first switch and the low level voltage supply to generate a first resistor voltage proportional to a first current flowing through the first inductor;

a second resistor having a third resistor terminal and a fourth resistor terminal, the third resistor terminal coupled to the fourth switch terminal of the second switch and the fourth resistor terminal coupled to the low level voltage supply terminal of the low level voltage supply such that the second resistor couples between the second switch and the low level voltage supply to generate a second resistor voltage proportional to a second current flowing through the second inductor; and, a switch controller coupled to the first switch control terminal and the second switch control terminal, the switch controller for controllably coupling the second inductor lead of the first inductor to the low level voltage supply through the first resistor responsive to the first resistor voltage and for controllably coupling the fourth inductor lead of the second inductor to the low level voltage supply through the second resistor responsive to the second resistor voltage.

8. A method of rapidly energizing an electromagnetic actuator having at least one energizing coil to move a movable member, the method comprising:

establishing a first current through a first inductor in a first circuit;

coupling the first inductor in series with the coil in a second circuit;

interrupting the first circuit and directing the first current in the first inductor of the first circuit to flow through the coil in the second circuit;

establishing a second current through a second inductor in a third circuit;

coupling the second inductor in series with the coil in the second circuit; and interrupting the third circuit and directing the second current in the second inductor of the third circuit to flow through the coil in the second circuit.

9. The method of claim 8 wherein the first inductor is coupled in series with the coil through a first diode and the second inductor is coupled in series with the coil through a second diode.

10. The method of claim 8 wherein the coil is coupled to a positive power supply terminal through a third diode to provide a sustaining current through the coil.

11. A controller circuit for electromagnetic actuators having a first energizing coil to move a movable member of the electromagnetic actuator in a first direction and a second energizing coil to move the movable member of the electromagnetic actuator in a second direction, comprising:

the first coil having first and second coil leads;

first and second switches;

a first inductor having first and second inductor leads, the first inductor lead being coupled to a first power supply terminal, the first and second inductor leads being coupled to the first coil lead through first and second diodes, respectively;

the first switch controllably coupling the second inductor lead to a second power supply terminal;

the second switch controllably coupling the second coil lead to the second power supply terminal;

the second coil having third and fourth coil leads;

third and fourth switches;

a second inductor having third and fourth inductor leads, the third inductor lead being coupled to the first power supply terminal, the third and fourth inductor leads being coupled to the third coil lead through third and fourth diodes, respectively;

the third switch controllably coupling the fourth inductor lead to the second power supply terminal; and, the fourth switch controllably coupling the fourth coil lead to the second power supply terminal.

12. The controller circuit of claim 11 further comprised of a first switch controller for controlling the first and third switches.

13. The controller circuit of claim 12 wherein the first switch controller further controlling the second and fourth switches.

14. The controller circuit of claim 13 further comprising a first resistor coupled in series between the first switch and the second power supply terminal to generate a first resistor voltage proportional to a first current in the first inductor;

a second resistor coupled in series between the second switch and the second power supply terminal to generate a second resistor voltage proportional to a second current in the second inductor; and, the first resistor voltage and the second resistor voltage coupled to the switch controller for controlling the first and third switches.

* * * * *